US010490380B2

(12) United States Patent
Yao et al.

(10) Patent No.: US 10,490,380 B2
(45) Date of Patent: Nov. 26, 2019

(54) RELAY

(71) Applicant: BYD COMPANY LIMITED, Shenzhen, Guangdong (CN)

(72) Inventors: Baotong Yao, Shenzhen (CN); Zhichao Li, Shenzhen (CN)

(73) Assignee: BYD COMPANY LIMITED, Shenzhen, Guangdong (CN)

( * ) Notice: Subject to any disclaimer, the term of this patent is extended or adjusted under 35 U.S.C. 154(b) by 32 days.

(21) Appl. No.: 15/741,660

(22) PCT Filed: Aug. 30, 2016

(86) PCT No.: PCT/CN2016/097353

§ 371 (c)(1),
(2) Date: Jan. 3, 2018

(87) PCT Pub. No.: WO2017/036380

PCT Pub. Date: Mar. 9, 2017

(65) Prior Publication Data

US 2018/0197710 A1 Jul. 12, 2018

(30) Foreign Application Priority Data

Aug. 31, 2015 (CN) ..... 2015 1 0546556
Aug. 31, 2015 (CN) ..... 2015 2 0671874 U

(51) Int. Cl.
*H01H 89/00* (2006.01)
*H01H 9/10* (2006.01)
(Continued)

(52) U.S. Cl.
CPC ..... *H01H 89/00* (2013.01); *H01H 9/102* (2013.01); *H01H 45/14* (2013.01);
(Continued)

(58) Field of Classification Search
CPC ..... H01H 1/20; H01H 9/102; H01H 9/34; H01H 9/341; H01H 45/14; H01H 50/546;
(Continued)

(56) References Cited

U.S. PATENT DOCUMENTS 1,536,355 A 5/1925 William
5,604,475 A * 2/1997 Jackson ..... H01H 85/10 337/159

(Continued)

FOREIGN PATENT DOCUMENTS

CN 103117198 A 5/2013
CN 204927190 U 12/2015
JP 2005005243 A 1/2005

OTHER PUBLICATIONS

International Search Report from PCT/CN2016/097353 dated Nov. 28, 2016 (2 pages).

*Primary Examiner* — Jacob R Crum
(74) *Attorney, Agent, or Firm* — Calfee Halter & Griswold LLP

(57) ABSTRACT

A relay (100) is provided. The relay (100) includes an insulating housing (10) defining an accommodating cavity (11) therein; two binding posts (12) disposed to the insulating housing (10), each having an end extending into the accommodating cavity (11); an insulating plate (20) disposed within the accommodating cavity (11), movable between a first position and a second position, and having two connecting contacts (21) disposed on a first side of the insulating plate (20) facing the binding posts (12); a fuse (30) disposed between the two connecting contacts (21); a mounting base (40) connected to the insulating housing (10); and a push rod (41) movably disposed to the mounting base (40) and connected to the insulating plate (20), in which when the insulating plate (20) is located at the first position, the two connecting contacts (21) abut against the two
(Continued)

binding posts (12) respectively, and when the insulating plate (20) is located at the second position, the two connecting contacts (21) detach from the two binding posts (12) respectively.

11 Claims, 7 Drawing Sheets

(51) Int. Cl.

| | |
|---|---|
| ***H01H 50/54*** | (2006.01) |
| ***H01H 45/14*** | (2006.01) |
| ***H01H 85/08*** | (2006.01) |
| ***H01H 85/20*** | (2006.01) |
| ***H01H 85/42*** | (2006.01) |
| ***H01H 85/50*** | (2006.01) |
| ***H01H 85/02*** | (2006.01) |
| *H01H 9/34* | (2006.01) |
| *H01H 9/44* | (2006.01) |
| *H01H 85/10* | (2006.01) |
| *H01H 85/38* | (2006.01) |
| *H01H 1/20* | (2006.01) |
| *H01H 50/02* | (2006.01) |

(52) U.S. Cl.
CPC ..... *H01H 50/546* (2013.01); *H01H 85/0241* (2013.01); *H01H 85/08* (2013.01); *H01H 85/2045* (2013.01); *H01H 85/42* (2013.01); *H01H 85/50* (2013.01); *H01H 1/20* (2013.01); *H01H 9/34* (2013.01); *H01H 9/443* (2013.01); *H01H 85/10* (2013.01); *H01H 2050/025* (2013.01); *H01H 2085/383* (2013.01); *H01H 2221/044* (2013.01); *H01H 2235/01* (2013.01)

(58) Field of Classification Search
CPC .... H01H 85/0241; H01H 85/08; H01H 85/10; H01H 85/2045; H01H 2085/383; H01H 89/00; H01H 9/443; H01H 85/42; H01H 85/50; H01H 2050/025; H01H 2221/044; H01H 2235/01
USPC ..... 337/400
See application file for complete search history.

(56) References Cited

U.S. PATENT DOCUMENTS

| | | | | |
|---|---|---|---|---|
| 2004/0027776 | A1* | 2/2004 | Uotome | H01H 47/06 361/160 |
| 2007/0241847 | A1* | 10/2007 | Yamamoto | H01H 50/305 335/196 |
| 2011/0156845 | A1* | 6/2011 | Eum | H01H 51/065 335/154 |
| 2012/0090165 | A1* | 4/2012 | Yeon | H01H 49/00 29/622 |
| 2012/0092097 | A1* | 4/2012 | Choi | H01H 1/2008 335/188 |
| 2012/0139670 | A1* | 6/2012 | Yamagata | H01H 50/023 335/2 |
| 2013/0335176 | A1* | 12/2013 | Lee | H01H 50/042 335/187 |
| 2015/0015350 | A1* | 1/2015 | Tachikawa | H01H 1/66 335/131 |

* cited by examiner

RELAY

CROSS REFERENCE TO RELATED APPLICATION

The present application is based on International Application No. PCT/CN2016/097353, filed on Aug. 30, 2016, which claims priority to and benefits of Chinese Patent Application No. 201510546556.5, filed with the State Intellectual Property Office (SIPO) of the People's Republic of China on Aug. 31, 2015, and Chinese Patent Application No. 201520671874.X, filed with the State Intellectual Property Office (SIPO) of the People's Republic of China on Aug. 31, 2015, the entire contents of which are hereby incorporated by reference.

TECHNICAL FIELD

The present disclosure relates to a technology field of relay, and more specifically, to a relay.

BACKGROUND

Electrical connection between two connecting contacts of a relay in the related art is implemented by using a copper plate having a specific thickness, and when a current in an external circuit is excessively high, since the relay does not has an overload protection function, a component of a load circuit is easy to be damaged and has extremely low security. Further, the relay in the related art does not have an arc-extinguishing function and has a poor internal insulating capability, and a damage or breakdown phenomenon may easily occur in an element at a low-voltage end of the relay, which greatly shortens a service life of a device.

In addition, in a use process of the relay in the related art, it is necessary to additionally apply a protection apparatus, for example, an individual fuse apparatus, in a peripheral circuit where the relay is located, and the individually assembled fuse apparatus not only increases an amount of usage of electrical components in the circuit, but also needs a large installation space at the same time.

SUMMARY

The present disclosure aims at solving one of the technical problems in the related art to some extent. Therefore, the present disclosure provides a relay, which has a simple structure, and high reliability and security.

A relay according to embodiments of the present disclosure includes an insulating housing, two binding posts, an insulating plate, a fuse, a mounting base, and a push rod. The insulating housing defines an accommodating cavity therein, the accommodating cavity is open at one end thereof, the two binding posts is spaced apart from each other and disposed to the insulating housing, and an end of each of the two binding posts extends into the accommodating cavity. The insulating plate is disposed within the accommodating cavity, movable between a first position and a second position, and has two connecting contacts spaced apart from each other and disposed on a first side of the insulating plate facing the binding posts, and the two connecting contacts are corresponding to the two binding posts in terms of position respectively. The fuse is disposed between the two connecting contacts, and two ends of the fuse are electrically connected to the two connecting contacts respectively. The mounting base is connected to the insulating housing, and the push rod is movably disposed to the mounting base and connected to the insulating plate to push the insulating plate to move between the first position and the second position. When the insulating plate is located at the first position, the two connecting contacts abut against the two binding posts respectively, and when the insulating plate is located at the second position, the two connecting contacts detach from the two binding posts respectively.

With the relay according to the embodiments of the present disclosure, the fuse is disposed between two connecting contacts of the insulating plate, not only an electrical connection between the two connecting contacts can be implemented, so as to ensure that an external circuit implements an electrical connection thereof (i.e., the external circuit is switched on) when the connecting contacts are connected to the binding posts, but also can an overload protection function on the external circuit be realized, so as to prevent an electrical device of the external circuit form being burnt and damaged when a current therein is extremely high or the external circuit short-circuits, thus improving reliability and security of a system and effectively prolonging a service life of the electrical device. In addition, in the relay of the present disclosure, the fuse is combined with the relay, which not only reduces the number of electrical elements in the circuit, but also saves an installation space.

Some of the additional aspects and advantages of the present disclosure are provided in the description below, and some become obvious in the description below or are learned by means of practices of the present disclosure.

DETAILED DESCRIPTION

Embodiments of the present disclosure are described in detail below, and examples of the embodiments are shown in accompanying drawings. The following embodiments described by referring to the accompanying drawings are illustrative, aim at explaining the present disclosure, and should not be interpreted as limitations to the present disclosure.

A relay 100 according to embodiments of the present disclosure will be described in detail below by referring to FIG. 1 to FIG. 7.

Figure 1:
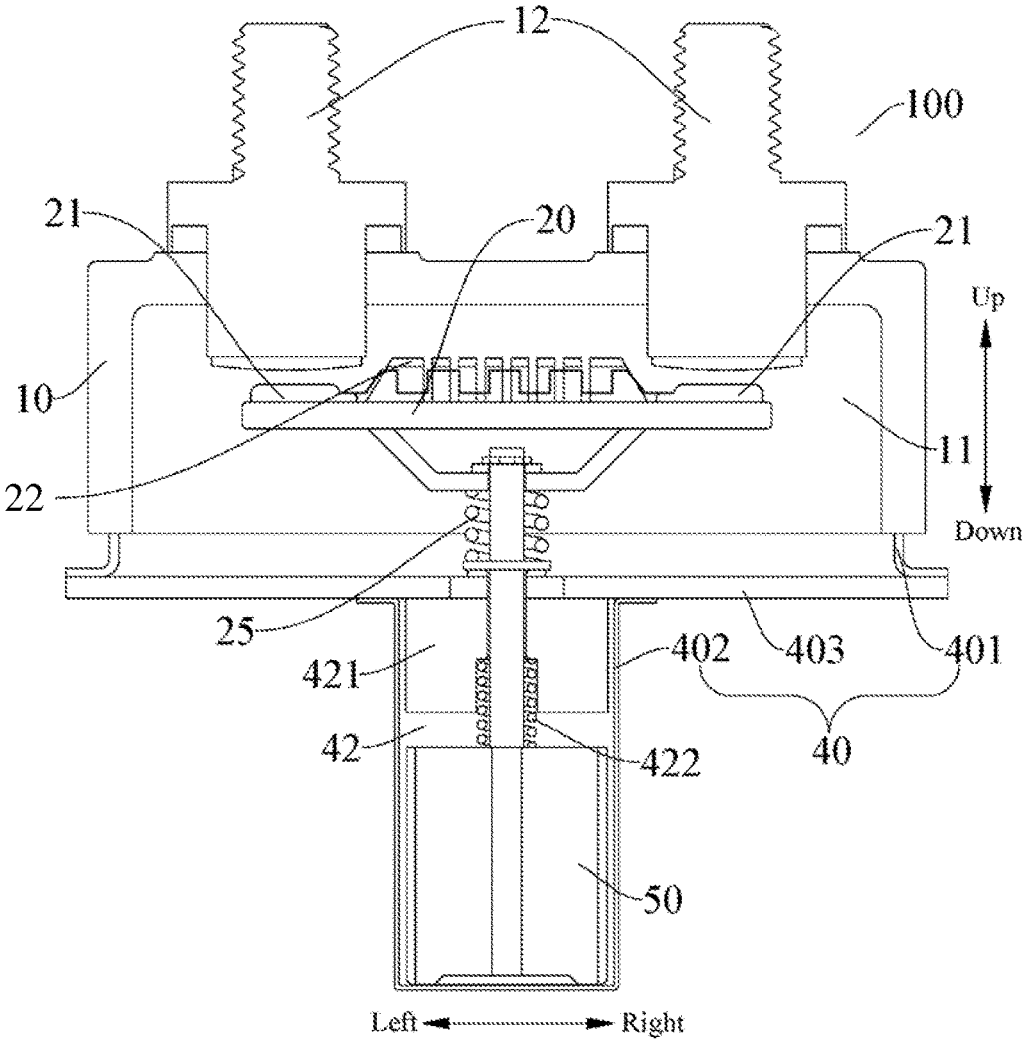
FIG. 1 is a schematic view of a relay according to an embodiment of the present disclosure, in which the relay is in a detached state.
Figure 2:
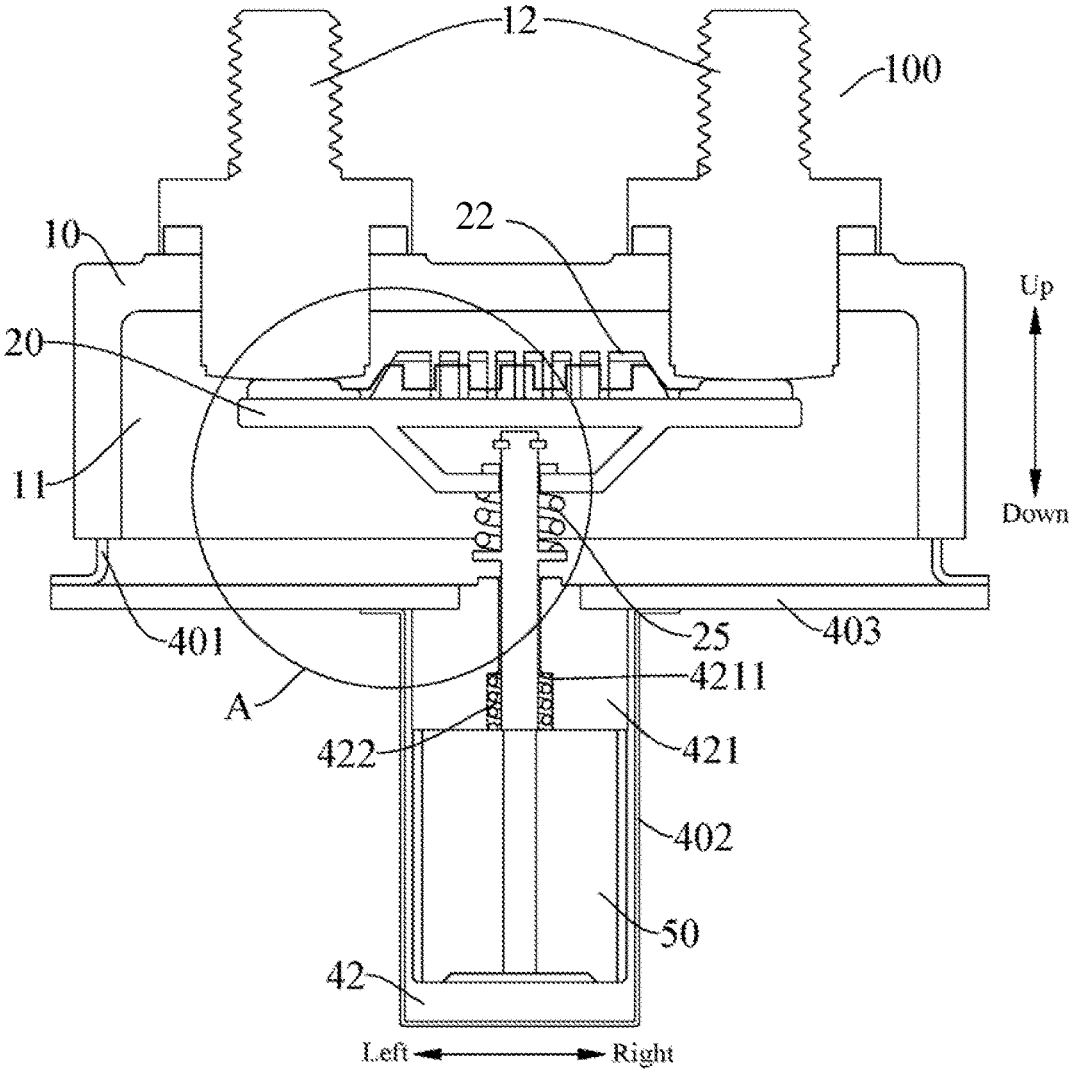
FIG. 2 is a schematic view of a relay according to an embodiment of the present disclosure, in which the relay is in a pickup state.

The relay 100 according to the embodiments of the present disclosure includes an insulating housing 10, an insulating plate 20, a fuse 30, and a mounting base 40. Specifically, the insulating housing 10 defines an accommodating cavity 11 therein, the accommodating cavity 11 is open at one end thereof, the insulating housing 10 is provided with two binding posts 12 spaced apart from each other, and an end of each of the two binding posts 12 extends into the accommodating cavity 11. The insulating plate 20 is disposed within the accommodating cavity 11, movable between a first position (a position state as shown in FIG. 2) and a second position (a position state as shown in FIG. 1), and has two connecting contacts 21. The two connecting contacts 21 are spaced apart from each other and disposed on a first side of the insulating plate 20 facing the two binding posts 12. The two connecting contacts 21 are corresponding to the two binding posts 12 in terms of position. That is, positions of the two connecting contacts 21 correspond to positions of the two binding posts 12 respectively.

When the insulating plate 20 is located at the first position, the two connecting contacts 21 abut against the two binding posts 12 respectively, and when the insulating plate 20 is located at the second position, the two connecting contacts 21 detach from the two binding posts 12. The fuse 30 is disposed between the two connecting contacts 21, and two ends of the fuse 30 are electrically connected to the two connecting contacts 21 respectively. The mounting base 40 is connected to the insulating housing 10, a push rod 41 is movably disposed to the mounting base 40, and connected to the insulating plate 20 to push the insulating plate 20 to move between the first position and the second position.

Figure 3:
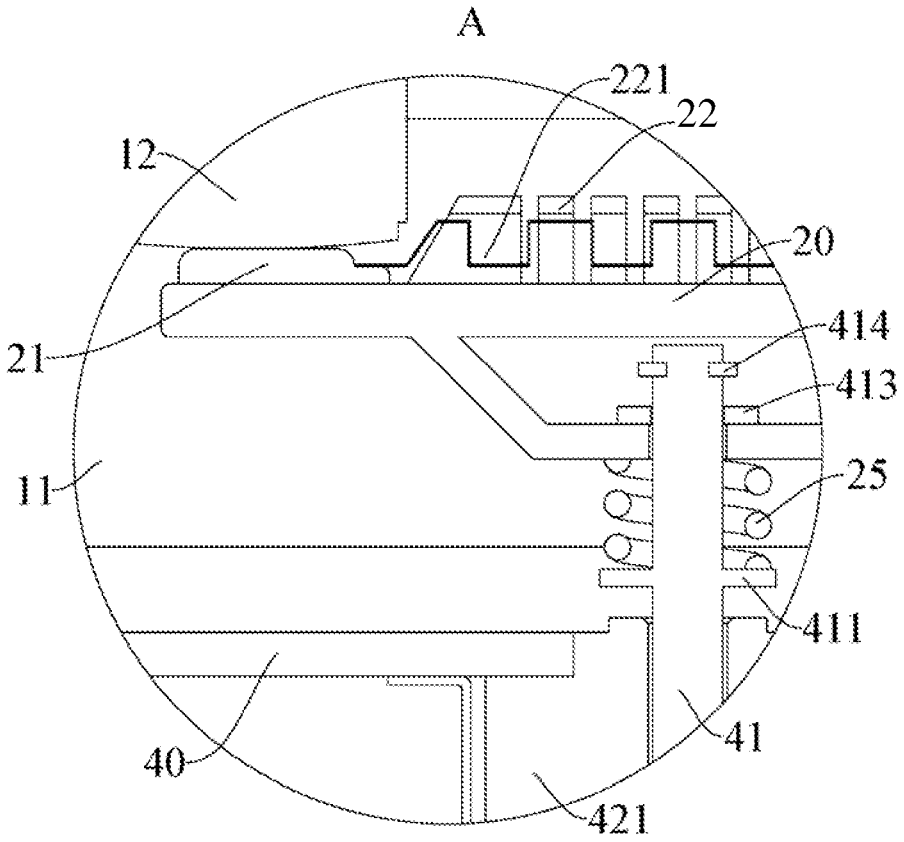
FIG. 3 is an enlarged view of part A in FIG. 2.

In other words, the relay 100 is mainly constituted by the insulating housing 10, the insulating plate 20, the fuse 30, and the mounting base 40. Specifically, as shown in FIG. 1 to FIG. 3, the insulating housing 10, the insulating plate 20, and the mounting base 40 extend along a horizontal direction (for example, a left-right direction shown in FIG. 1) respectively, the accommodating cavity 11 is defined within the insulating housing 10 and is open at a lower end thereof, the insulating housing 10 is disposed on the mounting base 40 and is connected to the mounting base 40 to seal the accommodating cavity 11. A top wall of the insulating housing 10 is provided with two binding posts 12 spaced apart from each other, upper ends of the two binding posts 12 exceed an upper surface of the insulating housing 10, and lower ends thereof penetrate through the top wall of the insulating housing 10 and extend into the accommodating cavity 11. The insulating plate 20 is movably disposed within the accommodating cavity 11, an upper end of the insulating plate 20 is provided with two connecting contacts 21 spaced apart from each other, and positions of the two connecting contacts 21 have one-to-one correspondence to positions of the two binding posts 12. The insulating plate 20 is further provided with the fuse 30, and two ends of the fuse 30 are connected to the two connecting contacts 21 respectively to implement an electrical connection between the two connecting contacts 21.

In some embodiments, the mounting base 40 includes a connection platform 401, a sleeve 402, and a supporting plate 403. The supporting plate 403 is configured as a plate body extending along the horizontal direction, and the connection platform 401 is disposed on the supporting plate 403 and is connected to an upper surface of the supporting plate 403. The sleeve 402 is disposed under the supporting plate 403, and an upper end of the sleeve 402 is connected to a lower surface of the supporting plate 403. A rod body (i.e., the push rod 41) extending along a vertical direction (an up-down direction as shown in FIG. 1) is movably disposed within the sleeve 402, and an upper end of the push rod 41 penetrates through the supporting plate 403 and is connected to the insulating plate 20 to push the insulating plate 20 to move within the accommodating cavity 11, thereby ensuring that the two binding posts 12 and the two connecting contacts 21 of the insulating plate 20 can switch between a pickup state (where the binding post 12 and the connecting contact 21 abut against and are connected with each other) and a detached state (where the binding post 12 and the connecting contact 21 detach from each other) respectively.

When the relay 100 is in a normal working process, the two binding posts 12 of the relay 100 are connected to two ends of an external circuit respectively, and the two binding posts 12 on the insulating housing 10 and the two connecting contacts 21 of the insulating plate 20 switch between the pickup state and the detached state respectively, thereby switching on or off the external circuit. Specifically, as shown in FIG. 2, when the insulating plate 20 is located at the first position, the two connecting contacts 21 of the insulating plate 20 abut against and are connected to the two binding posts 12 respectively, and further, the fuse 30 is disposed between the two connecting contacts 21, such that an electrical connection of the external circuit is implemented (i.e., the external circuit is switched on), and if a current of the external circuit is excessively high, the fuse 30 melts to cut off the circuit, so as to implement an overload protection function on the external circuit. Further, as shown in FIG. 1, when the insulating plate 20 is located at the second position, the two connecting contacts 21 of the insulating plate 20 detach from the two binding posts 12 respectively, and in this case, the external circuit is switched off.

Hence, with the relay 100 according to embodiments of the present disclosure, the fuse 30 is disposed between the two connecting contacts 21 of the insulating plate 20, not only the electrical connection between the two connecting contacts 21 can be implemented, so as to ensure that the electrical connection of the external circuit is implemented (i.e., the external circuit is switched on) when the two connecting contacts 21 are connected to the two binding posts 12, but also can the overload protection function on the external circuit be realized, so as to prevent the electrical device of the external circuit from being burnt and damaged when a current therein is extremely high or the external circuit short-circuits, thus improving reliability and security of a system and effectively prolonging a service life of the electrical device. In addition, in the relay 100 of the present disclosure, the fuse 30 is combined within the relay 100, which not only reduces the number of electrical elements in the circuit, but also saves an installation space.

Further, the mounting base 40 is connected to the insulating housing 10 and seals the accommodating cavity 11, and the accommodating cavity 11 is filled with an arc-extinguishing gas (not shown). It should be understood that the accommodating cavity 11 is full of the arc-extinguishing gas, which coats components, such as the binding post 12, the connecting contact 21, and the fuse 30, within the accommodating cavity 11, thereby implementing an arc-extinguishing function and preventing the electrical device of the external circuit from being burnt and damaged.

Figure 4:
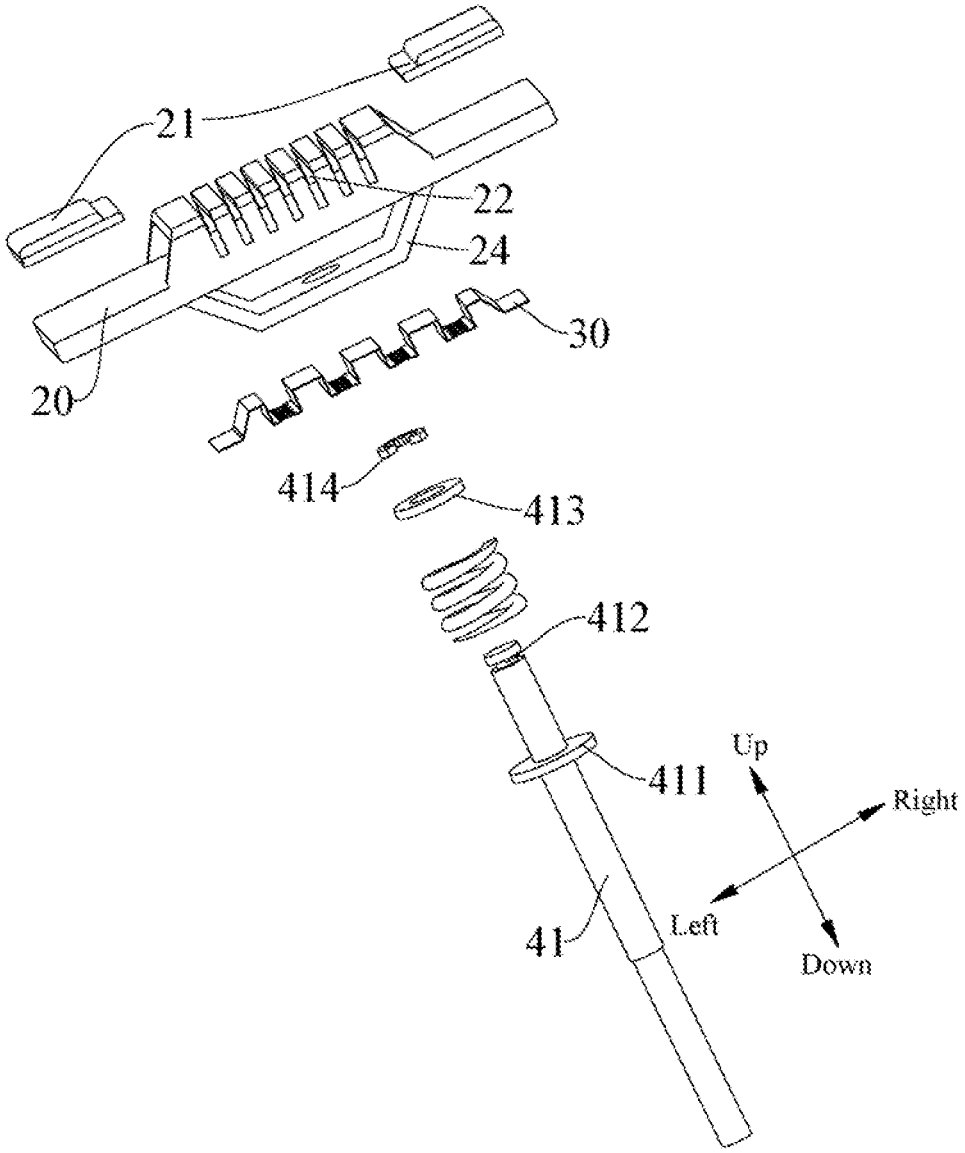
FIG. 4 is an exploded view of a partial structure of a relay according to an embodiment of the present disclosure.

As shown in FIG. 4, according to an embodiment of the present disclosure, multiple arc-extinguishing grids 22 are provided on the first side of the insulating plate 12 facing the two binding posts 12, a mounting groove 221 extending along a length direction of the insulating plate 20 is defined by the multiple arc-extinguishing grids 22, and the fuse 40 is disposed within the mounting groove 221.

That is, an upper side of the insulating plate 20 is provided with multiple mounting grooves 221 spaced apart from each other along the length direction (a left-right direction as shown in FIG. 3) of the insulating plate 20, so as to form the arc-extinguishing grids 22 on the upper side of the insulating plate 20, and the two connecting contacts 21 are disposed at two sides, namely, left and right sides, of the arc-extinguishing grid 22 respectively. The fuse 30 is disposed above the insulating plate 20, and at least a part of the fuse 30 is located within the mounting groove 221. Hence, by providing the multiple mounting grooves 221 in the insulating plate 20, it is convenient to mount and fasten the fuse 30, thereby preventing the fuse from falling off the insulating plate 20.

Optionally, as shown in FIG. 1, in some embodiments, the mounting groove 221 is configured as a through groove that runs through the multiple arc-extinguishing grids 22. By providing the through groove that runs through the arc-extinguishing grid 22 on the side, facing the binding posts 12, of the insulating plate 20, the arc-extinguishing gas within the accommodating cavity 11 can circulate all around, and the arc-extinguishing grid 22 and the through groove can divide an electrical arc into multiple segments, thereby achieving an objective of quickly extinguishing the electrical arc and effectively prolonging a service life of the relay 100.

Figure 5:
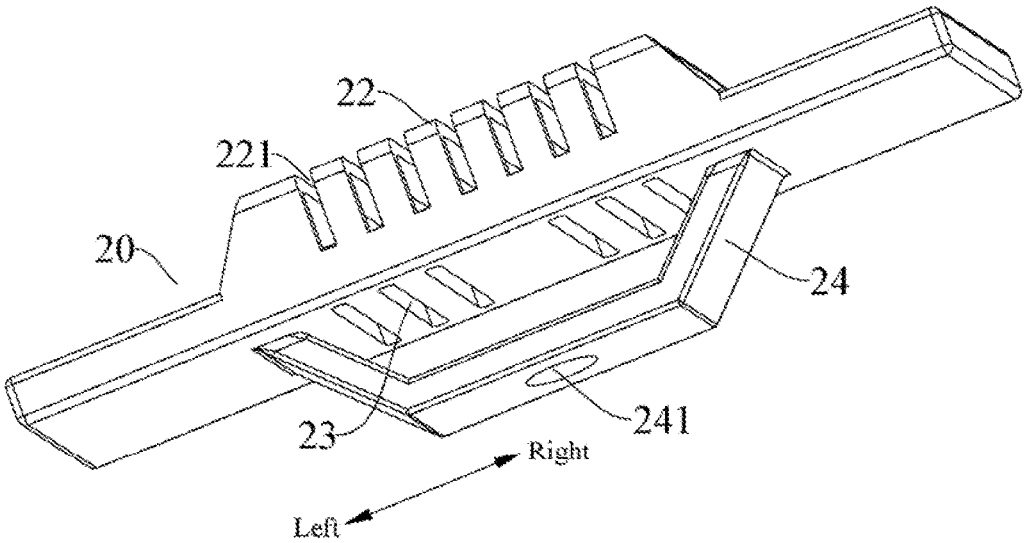
FIG. 5 is a schematic view of an insulating plate of a relay according to an embodiment of the present disclosure.

Further, the insulating plate 20 is provided with multiple through holes 23 that run through the insulating plate 20 along a thickness direction (an up-down direction as shown in FIG. 4) of the insulating plate 20 and that are in communication with the mounting groove 221. A second side, facing away from the binding posts 12, of the insulating plate 20 is provided with a mounting frame 24, and a first end of the push rod 41 is connected to the mounting frame 24. Specifically, as shown in FIG. 5, the insulating plate 20 is configured as a plate body extending along a horizontal direction (a left-right direction as shown in FIG. 4), and the mounting frame 24 is disposed under the insulating plate 20; two ends (specifically left and right ends) of the mounting frame 24 are connected to a lower surface of the insulating plate 20 respectively, a middle portion of the mounting frame 24 is provided with a mounting hole 241, and an upper end of the push rod 41 is mounted within the mounting hole 241 to implement a fixed connection to the insulating plate 20; the insulating plate 20 is further provided with multiple through holes 23 spaced apart from each other, and each through hole 23 penetrates through the insulating plate 20 and is in communication with the mounting groove 221.

When the relay 100 is working, the fuse 30 generates an electrical arc in a normal working process, and in this case, by providing the arc-extinguishing grids 22 on the first side, facing the binding posts 12, of the insulating plate 20, the arc-extinguishing grid 22 and the through hole 23 can divide the electrical arc into multiple segments, and meanwhile, under the effect of the arc-extinguishing gas around, the electrical arc can be quickly extinguished, thereby effectively prolonging a service life of the relay 100.

In some embodiments of the present disclosure, the fuse 30 is configured as a sheet extending along the length direction of the insulating plate 20, the fuse 30 includes multiple bending portions 32 spaced apart from or adjacent to each other in a length direction thereof, and each bending portion 32 is configured to have a rectangle shape, a triangle shape, or a trapezoid shape.

Figure 6:
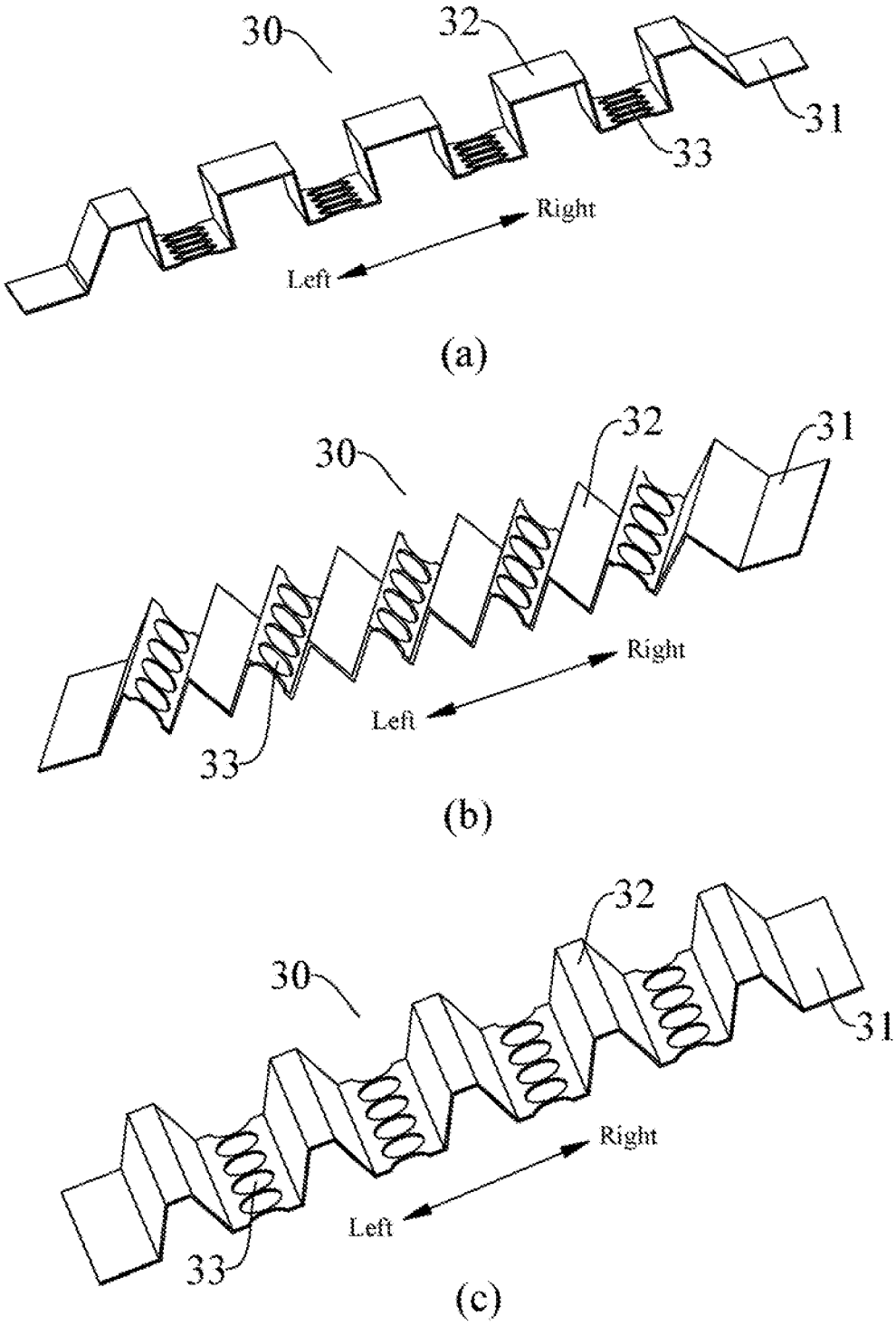
FIG. 6 is a schematic view showing multiple kinds of structures of a fuse of a relay according to an embodiment of the present disclosure.
Figure 7:
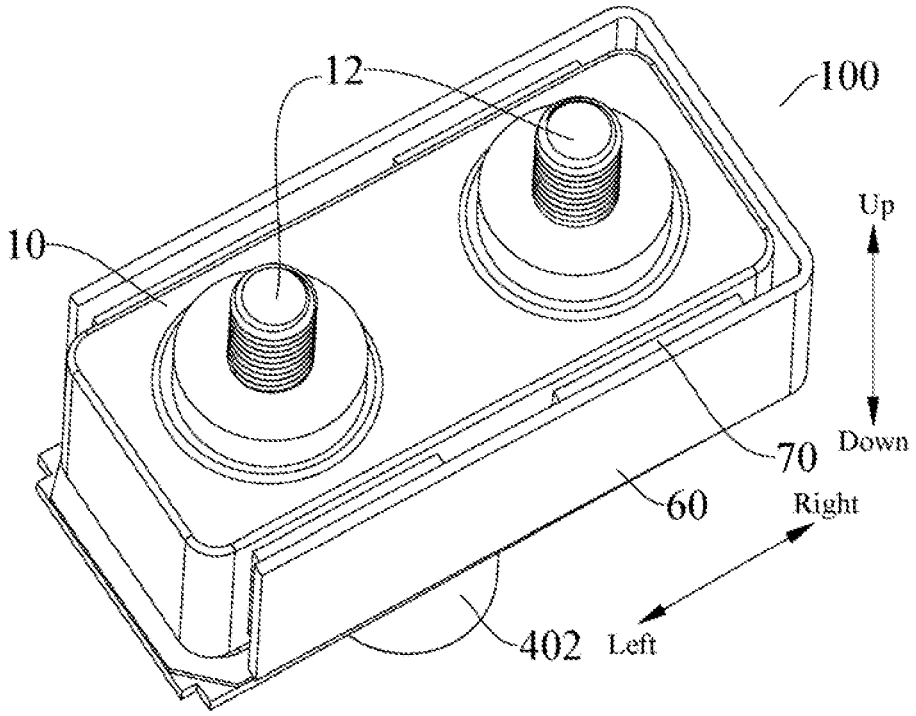
FIG. 7 is a schematic view showing an appearance of a relay according to an embodiment of the present disclosure.

Specifically, as shown in FIG. 6, the fuse 30 is configured as a sheet extending along the horizontal direction (a left-right direction as shown in FIG. 6), and the fuse 30 mainly includes a body portion 31 and a bending portion 32. As shown in FIG. 6(*a*), in this embodiment, the multiple bending portions 32 of the fuse 30 are configured as rectangle-shaped structures spaced apart from each other, each bending portion 32 protrudes beyond the body portion 31 of the fuse 30, and the body portion 31 between two bending portions 32 is provided with multiple air vents 33 spaced apart from each other. As shown in FIG. 6(*b*), in this embodiment, the multiple bending portions 32 of the fuse 30 are configured as triangle-shaped structures adjacent to each other, at least one side wall of each bending portion 32 is provided with multiple air vents 33 spaced apart from each other. Moreover, as shown in FIG. 6(*c*), in this embodiment, the multiple bending portions 32 of the fuse 30 are configured as trapezoid-shaped structures spaced apart from each other, each bending portion 32 protrudes beyond the body portion 31 of the fuse 30, and the body portion 31 between two bending portions 32 is provided with multiple air vents 33 spaced apart from each other.

However, in the related art, two connecting contacts are electrically connected to each other by a copper plate having a specific thickness, which has low security. With the relay 100 according to embodiments of the present disclosure, the fuse 30 is disposed between the two connecting contacts 21 of the insulating plate 20, not only the electrical connection between the two connecting contacts 21 can be implemented, so as to ensure that electrical connection of the external circuit is implemented (i.e., the external circuit is switched on) when the two connecting contacts 21 are connected to the two binding posts 12, but also can an overload protection function on the external circuit be realized, so as to prevent an electrical device of the external circuit from being burnt and damaged when a current therein is extremely high or the external circuit short-circuits, thus improving reliability and security of a system and effectively prolonging a service life of the electrical device.

As shown in FIG. 1 and FIG. 2, a mounting cavity 42 in communication with the accommodating cavity 11 is defined at a lower end of the mounting base 40, the push rod 41 is disposed within the mounting cavity 42, and the first end of the push rod 41 extends into the accommodating cavity 11 to be connected to the insulating plate 20. That is, the mounting cavity 42 is defined within the sleeve 402 and extends along a length direction (an up-down direction as shown in FIG. 2) of the sleeve 402, and the push rod 41 is disposed within the mounting cavity 42 and is movable along a length direction of the mounting cavity 42, thereby ensuring that the two binding posts 12 and the two connecting contacts 21 of the insulating plate 20 can switch between the pickup state (where the binding post 12 and the connecting contact 21 abut against and are connected with each other) and the detached state (where the binding post 12 and the connecting contact 21 detach from each other) respectively.

Specifically, as shown in FIG. 1 and FIG. 2, the relay 100 further includes a core 50 and a coil (not shown), the core 50 is movably disposed within the mounting cavity 42 and connected to a second end of the push rod 41, and the coil is disposed on a periphery of the core 50 and connected to a power supply (not shown). That is, the core 50 is disposed within the mounting cavity 42 and can move along the length direction of the mounting cavity 42, the upper end of the push rod 41 is connected to the insulating plate, and a lower end of the push rod 41 is connected to the core 50. Optionally, the core 50 and the push rod 41 may be fixedly connected with each other via laser welding or threaded connection. When the coil is powered up, the core 50 moves upward along the length direction of the mounting cavity 42 (i.e., the core 50 moves from a position state in FIG. 1 to a position state in FIG. 2), and during this process, the core 50 drives the push rod 41 to move upward so as to push the insulating plate 20 upward, such that finally the two connecting contacts 21 of the insulating plate 20 abut against and are connected to the two binding posts 12 of the insulating housing 10, thereby switching on the external circuit.

A limiting post 421 is disposed within the mounting cavity 42, and the limiting post 421 is located between the core 50 and a top wall of the mounting base 40 and abuts against the top wall of the mounting base 40. Specifically, the limiting post 421 is located between the core 50 and the supporting plate 403 of the mounting base 40 and abuts against the supporting plate 403 of the mounting base 40. A reset spring 422 is disposed between the limiting post 421 and the core 50, and two ends of the reset spring 422 respectively abut against the core 50 and the limiting post 421.

In other words, the limiting post 421 is provided at a side, adjacent to the supporting plate 403, of the mounting cavity 42, the limiting post 421 is fixedly connected to the supporting plate 403, and the core 50 is also disposed within the mounting cavity 42 and is located below the limiting post 421. Specifically, the reset spring 422 is disposed between the limiting post 421 and the core 50, and when the coil is powered off, the core 50 moves downward (i.e., the core 50 moves from the position state in FIG. 2 to the position state in FIG. 1) under the effect of the reset spring 422. At the same time, the core 50 drives the push rod 41 to move downward to pull the insulating plate 20 downward, and finally, the two connecting contacts 21 of the insulating plate 20 detach from the two binding posts 12 of the insulating housing 10, thereby switching off the external circuit.

Optionally, an upper end and a lower end of the reset spring 422 are connected to the limiting post 421 and the core 50 respectively. As shown in FIG. 2, in this embodiment, the limiting post 421 is provided with a relief groove 4211 at a side thereof adjacent to the core 50, the reset spring 422 is disposed within the relief groove 4211, one end (i.e., the upper end) of the reset spring 422 abuts against a top wall of the relief slot 4211, and the other end (i.e., the lower end) thereof abuts against an upper end surface of the core 50. Hence, by disposing the reset spring 422 between the limiting post 421 and the core 50, the core 50 can move from the position state in FIG. 2 to the position state in FIG. 1 under an elastic force of the reset spring 422, thereby ensuring that the relay 100 can work normally.

Advantageously, according to an embodiment of the present disclosure, a buffering member 25 is disposed between the mounting frame 24 and the push rod 41, and two ends of the buffering member 25 abut against the mounting frame 24 and the push rod 41 respectively.

Specifically, as shown in FIG. 4, the push rod 41 is provided with an abutting portion 411 extending along a circumferential direction of the push rod 41, and the upper end of the push rod 41 is provided with a clamping slot 412 recessed inwardly along the circumferential direction of the push rod 41. When the push rod 41 is disposed within the mounting cavity 42, the upper end of the push rod 41 extends into the mounting hole 241 of the mounting frame 24, and a circlip 414 is disposed within the clamping slot 412 of the push rod 41 to prevent the push rod 41 from falling off the mounting frame 24. Moreover, a washer 413 is disposed between a side, facing the insulating plate 20, of the mounting frame 24 and the circlip 414 to reduce a force applied to the circlip 414, so as to prevent the circlip 414 from falling off. In addition, the buffering member 25 is disposed between a side, facing the supporting plate 403, of the mounting frame 24 and the abutting portion 411, so as to implement a buffering function in a working process of the relay 100. When the coil is powered off, the core 50 moves downward (i.e., the core 50 moves from the position state in FIG. 2 to the position state in FIG. 1) under the effect of the reset spring 422 and an elastic member, thereby switching off the external circuit.

In an assembling process of the relay 100, the two connecting contacts 21 may be first welded to the upper surface of the insulating plate 20, then two ends of the fuse 30 are welded to and connected to the two connecting contacts 21 respectively, after that, the buffering member 25 is mounted on the abutting portion 411 of the push rod 41, and the upper end of the push rod 41 is enabled to penetrate through the mounting hole 241 of the mounting frame 24. Subsequently, the washer 413 and the circlip 414 are assembled to the push rod 41 in sequence, and the circlip 414 is disposed within the clamping slot 412 in the upper end of the push rod 41 in a clamping manner. Finally, the supporting plate 403, the reset spring 422, and the core 50 are mounted in sequence to complete assembling of the relay 100. The relay 100 has a simple structure and can be conveniently disassembled and assembled.

Optionally, according to an embodiment of the present disclosure, the insulating housing 10 and the insulating plate 20 are made of ceramic, that is, the insulating housing 10 and the insulating plate 20 both are ceramic members. The two binding posts 12, the connecting contacts 21 and the push rod 41 are respectively disposed at upper and lower sides of the insulating plate 20 made of ceramic materials, i.e., the two binding posts 12 and the connecting contacts 21 are disposed at the upper side of the insulating plate 20 made of ceramic materials, and the push rod 41 is disposed at the lower side of the insulating plate 20 made of ceramic materials, so as to isolate the push rod 41 from a high-voltage load, which implements a high-voltage insulating function and avoids an element at a low-voltage end from being damaged or broken down, thereby improving reliability and security of the relay 100.

In addition, the relay 100 further includes an external arc-extinguishing cover 60 and a magnet 70. The external arc-extinguishing cover 60 is disposed on a peripheral wall of the insulating housing 10, and the magnet 70 is disposed between the external arc-extinguishing cover 60 and the insulating housing 10. When the relay 100 is working, the fuse 30 generates an electrical arc in a normal working process, and under a magnetic field of the magnet 70, the electrical arc may be lengthened. In this case, by disposing the arc-extinguishing grids 22 on the side, facing the binding posts 12, of the insulating plate 20, the electrical arc may be divided into multiple segments by the arc-extinguishing grid 22. Meanwhile, under the comprehensive effect of the arc-extinguishing gas around and the external arc-extinguishing cover 60, the electrical arc can be extinguished quickly, thereby effectively prolonging a service life of the relay 100 and greatly improving security and reliability of the relay 100.

Other components of and operations on the relay 100 according to embodiments of the present disclosure are obvious to those ordinary skilled in the art, and thus detailed description thereof will be omitted herein.

In the description of the present disclosure, it should be understood that, location or position relationships indicated by the terms, such as "center", "longitude", "transverse", "length", "width", "thickness", "up", "down", "front", "rear", "left", "right", "vertical", "horizontal", "top", "bottom", "within", "outside", "clockwise", "counterclockwise", "axial", "radial", and "circumferential" are location or position relationships based on illustration of the accompanying drawings, are merely used for describing the present disclosure and simplifying the description instead of indicating or implying the indicated apparatuses or elements should have specified locations or be constructed and operated according to specified locations, and therefore, should not be intercepted as limitations to the present disclosure.

In addition, the terms such as "first" and "second" are used merely for the purpose of description, but shall not be construed as indicating or implying relative importance or implicitly indicating a number of the indicated technical feature. Hence, the feature defined with "first" and "second" may explicitly or implicitly include at least one of the features. In the description of the present disclosure, unless otherwise explicitly specifically defined, "multiple" means at least two, for example, two or three.

In the present disclosure, unless otherwise explicitly specified or defined, the terms such as "mount", "connect", "connection", and "fix" should be interpreted in a broad sense. For example, a connection may be a fixed connection, or may be a detachable connection or an integral connection; a connection may be a mechanical connection, or may be an electrical connection; a connection may be a mechanical connection, or may be an electrical connection, or may be used for intercommunication; a connection may be a direct connection, or may be an indirect connection via an intermediate medium, or may be communication between interiors of two elements or an interaction relationship between two elements, unless otherwise explicitly defined. It may be appreciated by those of ordinary skill in the art that the specific meanings of the aforementioned terms in the present disclosure can be understood depending on specific situations.

In the present disclosure, unless otherwise explicitly specified or defined, a first feature being "above" or "below" a second feature may be that the first and second features are in direct contact or that the first and second features in indirect contact by means of an intermediate medium. In addition, the first feature being "over", "above" or "on the top of" a second feature may be that the first feature is over or above the second feature or merely indicates that the horizontal height of the first feature is higher than that of the second feature. The first feature being "underneath", "below" or "on the bottom of" a second feature may be that the first feature is underneath or below the second feature or merely indicates that the horizontal height of the first feature is lower than that of the second feature.

In the descriptions of this specification, a description of a reference term such as "an embodiment", "some embodiments", "examples", "specific examples", or "some examples" means that a specific feature, structure, material, or characteristic that is described with reference to the embodiment or the example is included in at least one embodiment or example of the present disclosure. In this specification, exemplary descriptions of the foregoing terms do not necessarily refer to a same embodiment or example. In addition, the described specific feature, structure, material, or characteristic may be combined in a proper manner in any one or more embodiments or examples. Moreover, if there is no contradiction, those skilled in the art can joint and combine different embodiments or examples described in the description and features of different embodiments or examples.

Although the embodiments of the present disclosure have been shown and described, those of ordinary skill in the art can understand that multiple changes, modifications, replacements, and variations may be made to these embodiments without departing from the principle and purpose of the present disclosure.

What is claimed is:

1. A relay, comprising:

an insulating housing defining an accommodating cavity therein, wherein the accommodating cavity is open at one end thereof;

two binding posts spaced apart from each other and disposed to the insulating housing, wherein an end of each of the two binding posts extends into the accommodating cavity;

an insulating plate disposed within the accommodating cavity, movable between a first position and a second position, and comprising two connecting contacts spaced apart from each other and disposed on a first side of the insulating plate facing the binding posts, wherein the two connecting contacts are corresponding to the two binding posts in terms of position respectively, the insulating plate comprising multiple arc-extinguishing grids provided on the first side of the insulating plate facing the two binding posts, a mounting groove extending along a length direction of the insulating plate defined by the multiple arc-extinguishing grids;

a fuse disposed within the mounting groove and between the two connecting contacts, wherein two ends of the fuse are electrically connected to the two connecting contacts respectively;

a mounting base connected to the insulating housing; and a push rod movably disposed to the mounting base and connected to the insulating plate to push the insulating plate to move between the first position and the second position, wherein when the insulating plate is located at the first position, the two connecting contacts abut against the two binding posts respectively, and when the insulating plate is located at the second position, the two connecting contacts detach from the two binding posts respectively.

2. The relay according to claim 1, wherein the mounting base is connected to the insulating housing to seal the accommodating cavity, and the accommodating cavity is filled with an arc-extinguishing gas.

3. The relay according to claim 1, wherein the mounting groove is configured as a through groove running through the multiple arc-extinguishing grids.

4. The relay according to claim 1, wherein the insulating plate is provided with multiple through holes, the multiple through holes run through the insulating plate along a thickness direction of the insulating plate and are in communication with the mounting groove.

5. The relay according to claim 1, wherein the fuse is configured as a sheet extending along a length direction of the insulating plate, the fuse comprises multiple bending portions spaced apart from or adjacent to each other in a length direction thereof, and each bending portion is configured to have a rectangle shape, a triangle shape, or a trapezoid shape.

6. The relay according to claim 1, wherein a mounting cavity in communication with the accommodating cavity is defined at a lower end of the mounting base, the push rod is disposed within the mounting cavity, and a first end of the push rod extends into the accommodating cavity to be connected to the insulating plate.

7. The relay according to claim 6 further comprising a core and a coil, wherein the core is movably disposed within the mounting cavity and is connected to a second end of the push rod, and the coil is disposed on a periphery of the core and is connected to a power supply.

8. The relay according to claim 7, wherein a limiting post is disposed within the mounting cavity, the limiting post is located between the core and a top wall of the mounting base and abuts against the top wall of the mounting base, a reset spring is disposed between the limiting post and the core, and two ends of the reset spring abut against the core and the limiting post respectively.

9. The relay according to claim 1, wherein a mounting frame is provided at a second side of the insulating plate facing away from the binding posts, and a first end of the push rod is connected to the mounting frame.

10. The relay according to claim 9, wherein a buffering member is disposed between the mounting frame and the push rod, and two ends of the buffering member abut against the mounting frame and the push rod respectively.

11. The relay according to claim 1, wherein the insulating housing and the insulating plate are made of ceramic.

* * * * *